US007284659B2

(12) United States Patent
Sugarek et al.

(10) Patent No.: US 7,284,659 B2
(45) Date of Patent: Oct. 23, 2007

(54) HOLDER FOR GRIPS AND HANDLES

(76) Inventors: Steven L Sugarek, 910 Buoy Rd., Houston, TX (US) 77062-5113; C. Alan Sugarek, 6605 Rowan La., Houston, TX (US) 77074

( * ) Notice: Subject to any disclaimer, the term of this patent is extended or adjusted under 35 U.S.C. 154(b) by 29 days.

(21) Appl. No.: 11/182,670

(22) Filed: Jul. 16, 2005

(65) Prior Publication Data

US 2007/0012585 A1 Jan. 18, 2007

(51) Int. Cl.
*A63B 55/00* (2006.01)
*A63B 57/00* (2006.01)

(52) U.S. Cl. ..... 206/315.6; 206/315.2; 206/315.3; 211/70.2

(58) Field of Classification Search ..... 206/315.2, 206/315.6, 315.3, 315.11; 211/70.2
See application file for complete search history.

(56) References Cited

U.S. PATENT DOCUMENTS

| | | | | |
|---|---|---|---|---|
| 2,799,315 | A * | 7/1957 | Strasburg | 206/315.2 |
| 2,857,168 | A | 10/1958 | Neaverson et al. | |
| 2,970,629 | A * | 2/1961 | Masten | 206/315.2 |
| 3,164,185 | A | 1/1965 | Ingoldt | |
| 3,883,150 | A | 5/1975 | Varela | |
| 4,194,547 | A | 3/1980 | Sidor et al. | |
| 4,944,396 | A * | 7/1990 | Larkin | 206/315.6 |
| 4,964,683 | A | 10/1990 | Sugarek et al. | |
| 4,995,510 | A | 2/1991 | Fletcher, Jr. | |
| 5,050,884 | A | 9/1991 | Flory | |
| 5,135,107 | A | 8/1992 | Ingraham | |
| 5,275,278 | A | 1/1994 | Henry et al. | |
| 5,573,241 | A | 11/1996 | Anderson | |
| 5,575,720 | A | 11/1996 | Daniel | |
| 5,772,024 | A | 6/1998 | Lueders | |
| 5,834,738 | A * | 11/1998 | Wilson | 219/400 |
| 6,102,202 | A | 8/2000 | Jones | |
| 6,155,418 | A | 12/2000 | Chang | |
| 6,209,721 | B1 | 4/2001 | Sharpe et al. | |
| 6,216,864 | B1 | 4/2001 | Chang | |
| 6,269,947 | B1 | 8/2001 | Chang | |
| 6,352,187 | B2 | 3/2002 | Strode | |
| 6,464,076 | B2 | 10/2002 | Tan | |
| 6,619,475 | B2 | 9/2003 | Chang | |
| 6,929,124 | B2 | 8/2005 | Kawasaki | |
| D510,805 | S | 10/2005 | Wang | |

* cited by examiner

*Primary Examiner*—Sue A. Weaver
(74) *Attorney, Agent, or Firm*—John R Casperson

(57) ABSTRACT

A tube for accommodating a golf club is provided with internal structure to prevent rotation of the club and to centralize the club shaft. The structure to prevent rotation of the club is positioned in the passage near the bottom end of the tube. The structure to centralize the club shaft is positioned in the passage near the top end. A plurality of tubes so equipped can be provided in bundle form inside of the golf bag.

6 Claims, 6 Drawing Sheets

HOLDER FOR GRIPS AND HANDLES

FIELD OF THE INVENTION

This invention relates to an anti-rotation device for releasably holding long, slender, rotationally symmetric implements, for example, grips such as golf club grips or handles such as fishing rod handles, in a holder or carrier.

BACKGROUND OF THE INVENTION

The handles for many hand-held implements are generally rotationally symmetric, and this makes it difficult to position such implements in conventional holders in a stable orientation. For devices such as golf clubs or fishing rods, the holder is generally a tube into which the grip or handle is inserted, and the object in the holder is generally freely movable both longitudinally and rotationally. The rotational freedom of movement can be undesirable.

In the case of golf clubs, the golf club heads protruding from the golf bag will generally seek a downward orientation, due to gravity, and may come into contact with adjacent golf clubs, causing marring or structural damage. Currently, golf club head covers are sold to prevent this from occurring. A device which restrains the rotational movement under ordinary conditions would prevent the damage, and would eliminate the need for the covers.

The rotation of the club heads also changes the center of gravity of the bag, and this can be undesirable if the bag is being handled or carried. A device which permits the club heads to be retained in a desired orientation would prevent this. It would also make a bag full of clubs quieter to carry. Also, in the case of a carry bag, use of such a device would permit the center of gravity of the bag to be more in alignment with the user's center of gravity, making the bag easier to carry.

In the case of fishing rods, tubular holders are often used to position the rods on a boat. While some holders have a cross pin at the bottom to engage with a slot across the bottom of the rod and prevent rotational movement, not all holders nor all rods are so equipped. Rotation of the rods while the boat is underway or drifting can wrap deployed fishing line around the rod tip and cause a break-off when a fish strikes the lure or bait. Rotation of the rods in closely deployed holders can cause adjacent reels to impact each other and be marred or structurally damaged when the boat is underway. For this application, also, an anti-rotation device would be desirable.

OBJECTS OF THE INVENTION

It is an object of this invention to provide a holder for implement handles or grips which resists rotation but which permits the implement to be easily withdrawn from the holder.

It is another object of this invention to provide a holder which is well adapted to restrain rotationally symmetric grips or handles, such as those on golf clubs or fishing rods, from free rotational movement.

It is another object of this invention to provide a holder for golf clubs and fishing rods having an anti-rotation device which is actuated by dropping the club or rod into the holder.

SUMMARY OF THE INVENTION

In one embodiment of the invention, an apparatus comprises a tube and an anti-rotation means. The tube defines a passage and has a top end, a bottom end, an inside surface, and an outside surface. The shaft anti-rotation means is positioned in the passage near the bottom end of the tube.

Preferably, the anti-rotation means at least one slide body positioned inside of the tube. In one embodiment, the slide body comprises a flexible, more preferably elastomeric, slide body or tongue positioned inside of the tube. The slide body has a top end and a bottom end and extends downwardly from a position adjacent the inside surface of the tube at the top end of the rubbery slide body toward the longitudinal axis of the tube, to partially block the passage through the tube. The slide body provides grip to resist rotation of the shaft to be restrained and the slide shape permits actuation of the anti-rotation means simply by dropping the shaft or handle into the tube. Forming the slide body from a rubbery material enhances the grip. In another embodiment, a single or a plurality of circumferentially-spaced wedge-shaped slide bodies is positioned in the passage near the bottom end. In this embodiment, the slide bodies can be constructed of thermoplastic, and can be individually connected to the bottom face plate or carried on a bottom face plate as part of an injection molded assembly.

To prevent the golf club shafts from rubbing against the tube ends or the club heads from striking one another, or striking against adjacent shafts, a shaft centering means is preferably further positioned in the passage near the top end. A preferred shaft centering means is formed by at least one resilient shaft-centering body positioned flap-like inside of the tube. The resilient shaft-centering body preferably has an arcuate surface which assumes a generally concentric position around the longitudinal axis of the tube when the shaft-centering body is in a relaxed position. The structure permits the shaft centering means to deform out of the way when a shaft is dropped into the tube, and to rebound into an actuated position once the anti-rotation means has been engaged at the bottom of the tube.

For a golf bag application, the invention is preferably employed in the form of a tube bundle. The tube bundle comprises a top face plate, a bottom face plate, and a plurality of tubes. The top face plate defines a plurality of apertures. The plurality of tubes extends between the face plates. The tubes define a plurality of passages leading from the apertures in the top face plate. The shaft anti-rotation means are positioned in the passages near the bottom face plate, and the shaft centering means are positioned in the passages near the top face plate. The bundle is readily deployed in a golf club bag wherein a cover surrounds the tube bundle.

DETAILED DESCRIPTION OF THE INVENTION

Figure 1:
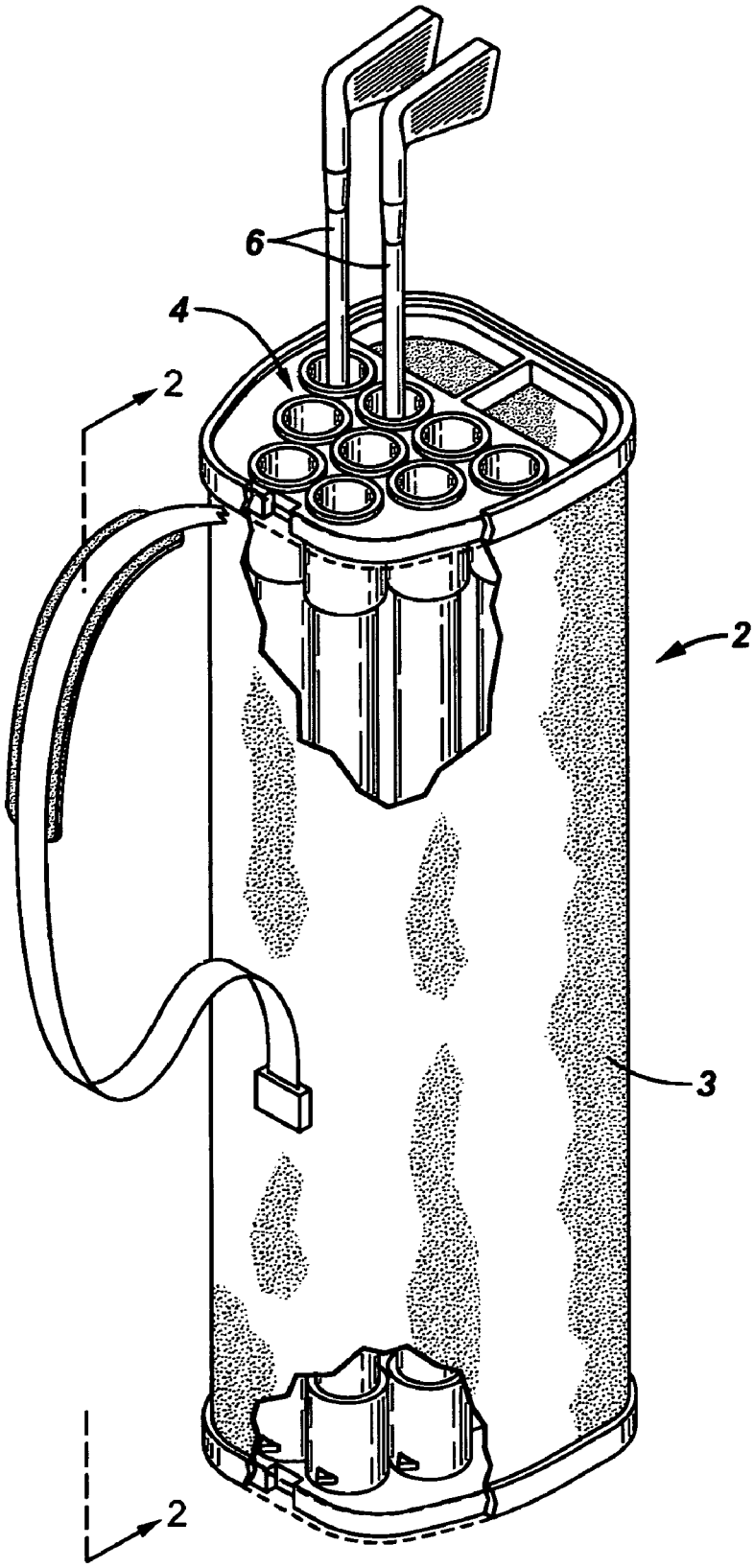
FIG. 1 is a pictorial representation of a golf club bag according to one embodiment of the invention.

With reference to FIG. 1, a golf bag 2 is provided with a tube bundle 4 for holding a plurality of golf clubs 6. The golf bag includes a covering 3 which laterally surrounds the tube bundle.

Figure 2:
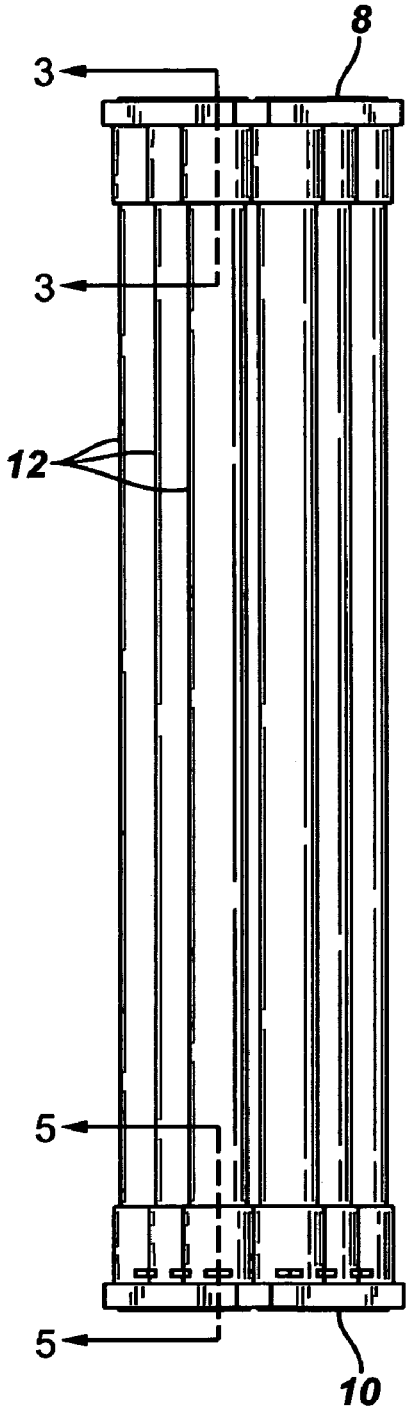
FIG. 2 is a side view of a portion of the golf club bag shown in FIG. 1.

With reference to FIG. 2, the tube bundle comprises a top face plate 8, a bottom face plate 10, and a plurality of tubes 12. The top face plate defines a plurality of apertures and the plurality of tubes extend between the face plates. The tubes define a plurality of passages leading from the apertures in the top face plate.

Figure 3:
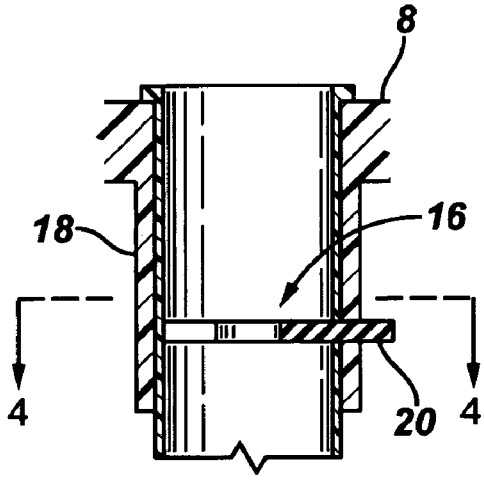
FIG. 3 is a cross sectional view of a portion of the device shown in FIG. 2 taken along lines 3-3.
Figure 5:
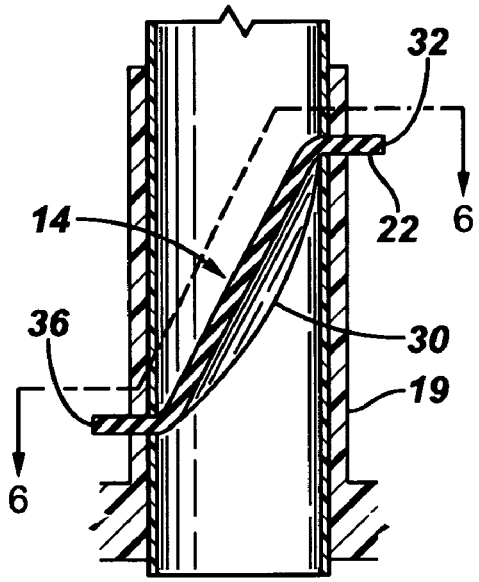
FIG. 5 is a cross sectional view of a portion of the device shown in FIG. 2 taken along lines 5-5.
Figure 6:
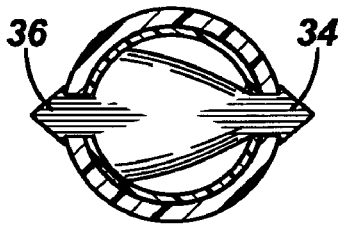
FIG. 6 is an end view of the device shown in FIG. 5 from the perspective of lines 5-5.
Figure 17:
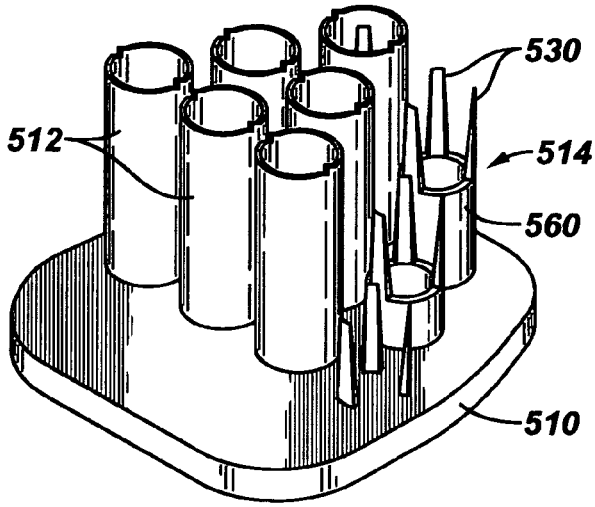
FIG. 17 is a pictorial representation of a bottom face plate for a golf club bag according to another embodiment of the invention.

As shown in FIG. 5, for example, a shaft anti-rotation means 14 is positioned in each of the passages near the bottom face plate. FIG. 17, for example, shows alternative shaft anti-rotation means 514. As shown in FIG. 3, for example, a shaft centering means 16 is positioned in each of the passages near the top face plate. The tube bundle is capable of separate manufacture, from thermoplastic such as polyethylene, for example, and is readily deployed in a golf club bag to form a finished product by attaching the covering, by stapling, for example.

In one embodiment of the invention, the top face plate and the bottom face plate are identical, to reduced manufacturing costs. Each preferably defines a plurality of apertures. A wide range of tubes can be employed, the number selected being preferably determined by personal preference or the limits defined by the rules of the game. For example, nine tubes could be employed to position nine clubs, and five more clubs could be positioned in the common area. In this embodiment, the top face place and the bottom face plate each preferably further define a plurality of sockets 18 (see FIG. 3, for example) surrounding the plurality of apertures, and the sockets of the top face plate are oriented to face the sockets 19 of the bottom face plate (See FIG. 5). The arrangement provides for stable attachment of the tubes. The tubes, which can be of the type already known, are positioned inside of the sockets. As shown in FIG. 3, the tubes can be fastened to the sockets of the top face plate by a portion 20 of the shaft centering means. Similarly, (see FIG. 5) the tubes can be fastened to the sockets of the bottom face plate by a portion 22 of the shaft anti-rotation means. Aligned apertures in the sockets and the tubes provide a passage for receipt of the portions of the shaft centering means and the anti-rotation means for providing the attachment mechanism.

Figure 16:
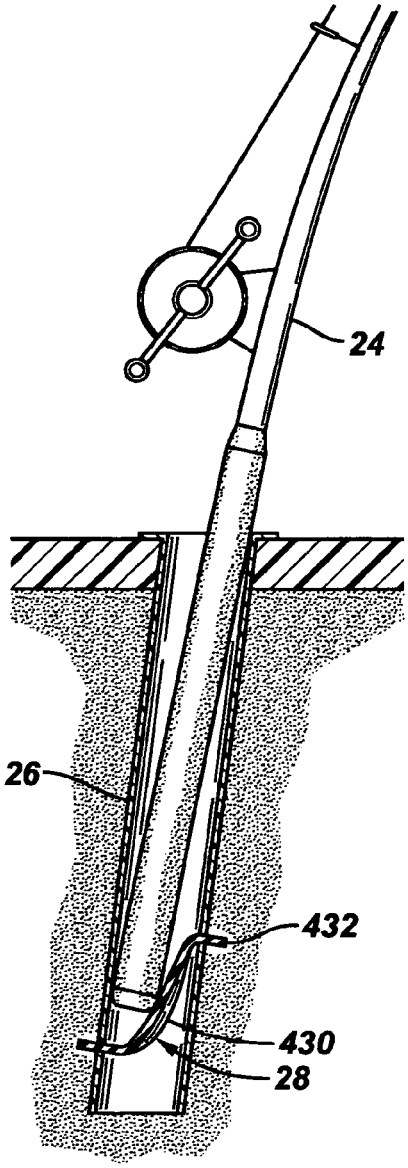
FIG. 16 is a view of another embodiment of the invention in use with a fishing rod.

A single tube embodiment of the invention can also be employed to hold a fishing rod 24. See FIG. 16. The apparatus comprises a tube 26 and an anti-rotation means 28 positioned near the bottom of the tube. For this application, an outwardly extending flange can be provided to secure the holder to the gunwale of a boat. The tube defines a passage and has a top end, a bottom end, an inside surface, and an outside surface. The shaft anti-rotation means is positioned in the passage near the bottom end of the tube. For a golf club application as shown in FIGS. 1-15 and 17, a shaft centering means would preferably be positioned in the passage near the top end.

The shaft anti-rotation means shown in FIGS. 5-11 and 13 is preferably formed from an elastomeric material. Rubber, natural or synthetic, is preferred although most any material which has resilience, memory and a high coefficient of friction should be broadly suitable. Fabric reinforced rubber taken from a bicycle tire was tested in a prototype with good results.

The shaft centering means is preferably formed from a resilient material. Rubber taken from a bicycle tire was used in the prototype with good results, although a slick, stiff and resilient, sheet plastic material would also be suitable.

The anti-rotation means functions by guiding a shaft or handle end to a wedged position between the anti-rotation means and an inside surface of the tube, or alternatively, between portions of the anti-rotation means.

In the embodiments shown by FIGS. 5-11 and 13, the anti-rotation means comprises a flexible, preferably rubbery, slide body 30 positioned inside of the tube. See FIGS. 5 and 8 for example. See also alternative rubbery slide body 130 in FIGS. 9-11, rubbery slide body 230 in FIG. 13, and rubbery slide body 430 in FIG. 16. The slide body has a top end and a bottom end and extends downwardly from a position adjacent the inside surface of the tube at the top end of the slide body toward the longitudinal axis of the tube, to at least partially block the passage through the tube. The slide body provides grip to resist rotation of the shaft to be restrained and the slide shape permits actuation of the anti-rotation means simply by dropping the shaft or handle into the tube.

For these embodiments, the slide body is preferably in the form of a thick sheet which is narrow at the top end and becomes wider toward the bottom end. Preferably, the slide body has a longitudinal axis, and a curvature across the longitudinal axis. As shown best by FIGS. 5, 6 and 8, the curvature is preferably convex upwardly and away from the position adjacent the inside surface of the tube at the top end of the slide body.

In the embodiment shown in FIG. 5, the slide body has a tip 32 protruding past the upper end of the slide body which is received through an aperture in the tube. See also tip 132 in FIG. 9, 232 in FIG. 13, and 432 in FIG. 16. The tip has a head portion 34 positioned alongside the outside surface of the tube which is too large to easily pass through the aperture. See FIG. 5, for example. Preferably, the head portion is generally arrowhead-shaped.

In certain embodiments, the slide body has a second tip 36 protruding past the bottom end of the slide body which is received through a second aperture in the tube. See FIGS. 5 and 6. It also, can be provided with a head portion, preferably arrowhead-shaped, which is too large to easily pass through the second aperture.

Figure 9:
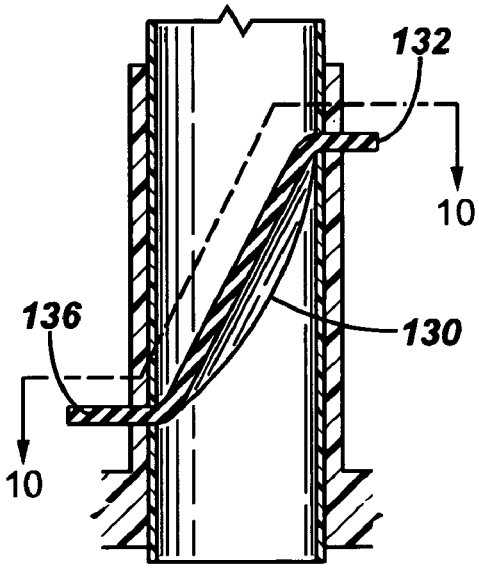
FIG. 9 is a cross sectional view as in FIG. 5 of a modified device.
Figure 11:
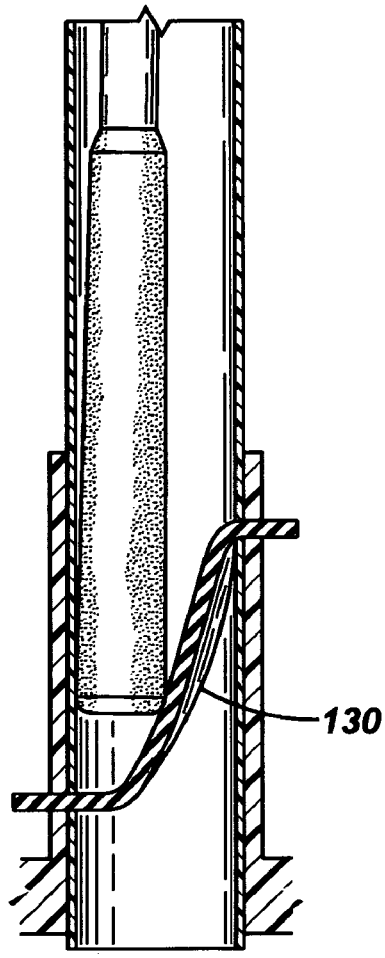
FIG. 11 is a view of the device as in FIG. 9 in use to hold a club.
Figure 10:
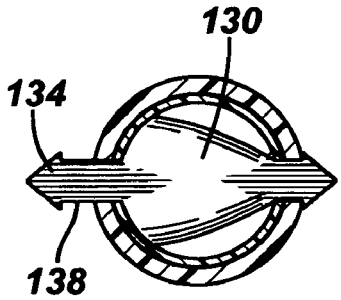
FIG. 10 is an end view of the device as shown in FIG. 9 from the perspective of lines 10-10.
Figure 12:
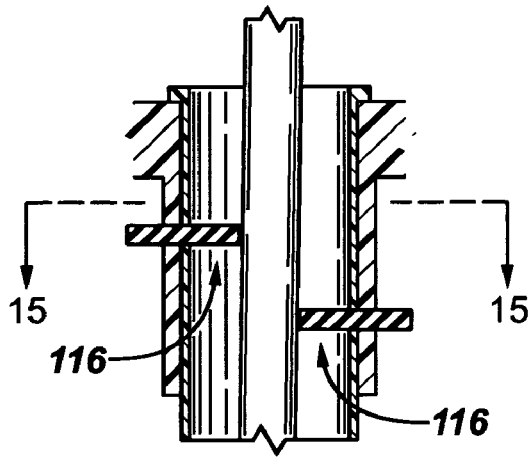
FIG. 12 is a cross sectional view as in FIG. 7 of a modified device.
Figure 13:
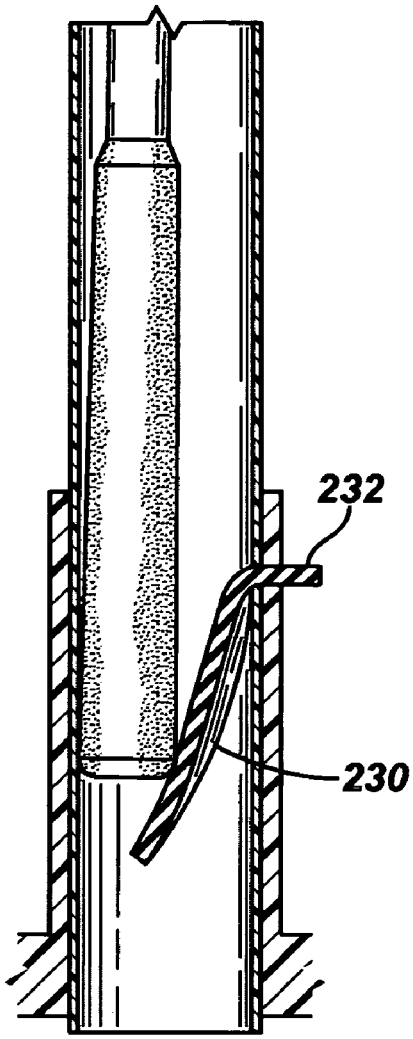
FIG. 13 is a cross sectional view as in FIG. 8 of another modified device.

In the embodiment shown in FIGS. 9-11, the second tip 136 has a head portion 134 and an elongated neck portion 138 connecting the head portion with the bottom end of the slide body. The neck portion is slidably received by the second aperture and the head portion, when the slide body is in the relaxed position, and the head portion is spaced apart from the outside surface of the tube. Similar to earlier described embodiments, the head portion is too large to easily pass through the second aperture, and is preferably arrowhead-shaped. As shown by comparison of FIGS. 9 and 11, the slide body moves from a first position to a second position when the club is inserted, pulling the second tip into the passage until it is stopped by contact of the head on the outside of the tube.

Figure 14:
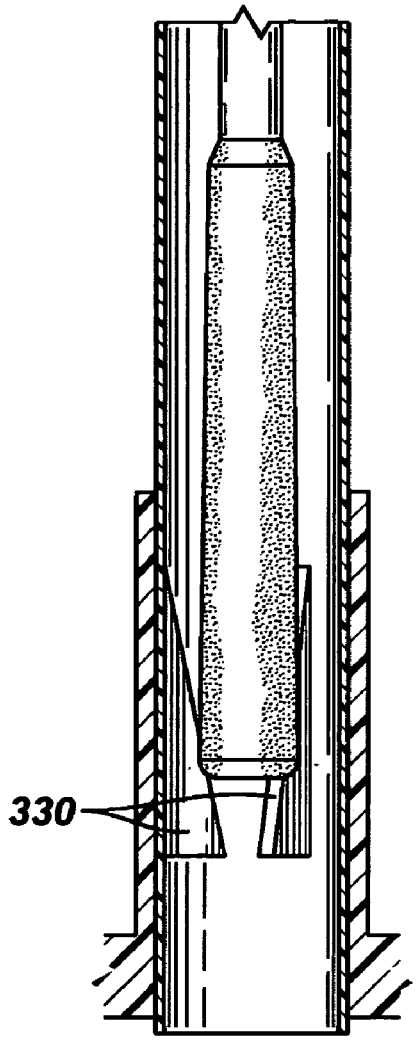
FIG. 14 is a cross sectional view as in FIG. 13 of still another modified device.
Figure 15:
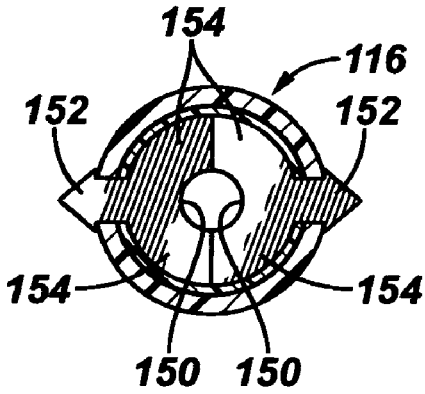
FIG. 15 is an end view of the device as in FIG. 12 from the perspective of lines 15-15.

In the embodiment shown in FIG. 14 the shaft anti-rotation means 330 extends upwardly into the passages. Each shaft anti-rotation means includes one or more wedge-shaped slide bodies made of a semi-rigid material on the inner wall or spaced around the inner wall of the passage near the bottom of the passage. Each wedge-shaped slide body can be manufactured as a unit with the tube or attached to the inner wall of the tube. Each wedge-shaped slide body preferably has an angled inner surface positioned at an angle of 1 degree to 45 degrees, preferably from 4 to 25 degrees, with respect to the longitudinal axis of the tube and converging downwardly toward the longitudinal axis of the tube With reference to the embodiments of the invention shown in FIG. 17, the shaft anti-rotation means 514 extends upwardly into the passages from the bottom face plate 510. Each shaft anti-rotation means preferably comprises a plurality of wedge-shaped slide bodies 530 circumferentially spaced around the passage near the bottom end of the passage, each slide body having a top end, a bottom end, an outer surface positioned closely adjacent to the inside surface of the tube 512, an angled inner surface preferably positioned at an angle of 1 degree to 45 degrees, more preferably in the range of 4 to 25 degrees, with respect to the longitudinal axis of the tube and converging in a downward direction toward a longitudinal axis of the tube. Each slide body can have a width, as measured radially from the longitudinal axis of the tube, of between about 1 and about 45 degrees, preferably about 3 degrees and about 30 degrees. Each slide body most preferably has a right triangle shape when viewed in cross-section in a radial plane from the tube axis. Generally speaking, one or more slide bodies would be positioned in each tube. For example, from 2 to 12 such slide bodies would be positioned in each tube. The bottom ends of the wedge shaped slide bodies can be positioned on the bottom plate, or positioned on a spacer 560 which is positioned on the bottom plate. Preferably, in at least a portion of the tubes, the bottom ends of the wedge-shaped slide bodies are positioned on a spacer 560 which is positioned on the bottom plate, as this provides for better vertical club head separation. Each spacer preferably has a generally cylindrical outer surface which is closely received by a tube, to provide for positive location of the tube. The slide bodies can be flexible, to retain a bias against the inner tube wall so that the upper end of each slide body is closely adjacent the tube wall to prevent the club handles from snagging prior to being engaged by the slide bodies. For reliable engagement, the inner surfaces of the plurality of wedge-shaped slide bodies are shaped and positioned to closely accommodate a handle having a diameter in the range of ¾ to 1½ inches, preferably 15/16 to 1¼ inches, which is the typical range of golf club handle diameters. However, the invention could be used for handle diameters outside of this range, for other applications for example. The entire assembly can be formed from injection molded thermoplastic, for example, or each slide wedge body and optional spacer could be individually connected to the bottom face plate with adhesive or via plastic welding technique, for example, or threadably connected, for more universal applications such as for retrofitting an existing golf bag.

Figure 4:
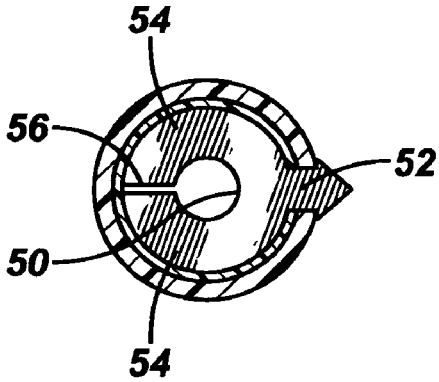
FIG. 4 is an end view of the device shown in FIG. 3 from the perspective of lines 4-4.
Figure 7:
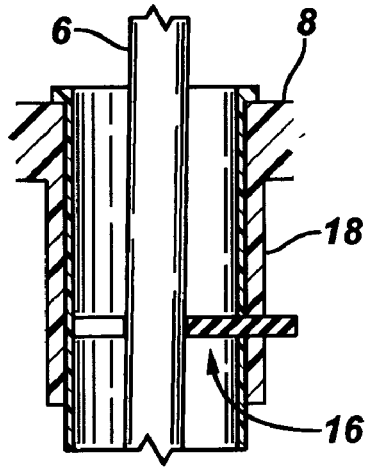
FIG. 7 is a view of the device as in FIG. 3 in use to hold a club.
Figure 8:
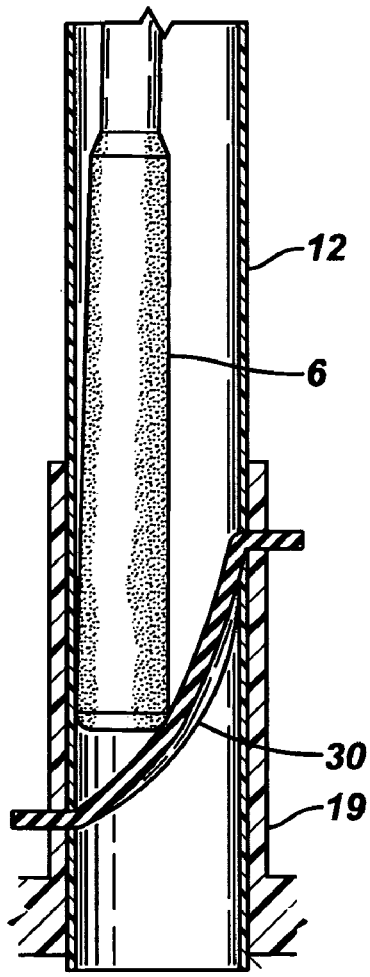
FIG. 8 is a view of the device as in FIG. 5 in use to hold a club.

As mentioned, for use with golf clubs, a shaft centering means is preferably further positioned in the passage near the top end. Examples of shaft centering means are shown in FIGS. 3, 4 and 7 (means 16) and in FIGS. 12 and 15 (means 116). A preferred shaft centering means is formed by at least one resilient shaft-centering body positioned flap-like inside of the tube. The resilient shaft-centering body preferably has an arcuate surface 50, 150 which assumes a generally concentric position around the longitudinal axis of the tube when the shaft-centering body is in a relaxed position. The structure permits the shaft centering means to deform out of the way when a shaft is dropped into the tube, and to rebound into an actuated position, which is the position shown in the drawings, once the anti-rotation means has been engaged at the bottom of the tube. The resilient shaft-centering body is preferably positioned near the top end of the tube, because that position provides the best restraint for the clubs.

Both embodiments of illustrated shaft centering bodies can be described as being bifurcated fork-shaped, having a handle portion 52, 152 and a pair of tine portions 54, 154, the tine portions forming the partially annular shape and the handle portion passing through an aperture in the tube for mounting the shaft-centering body therein. In the embodiment shown in FIGS. 12 and 15, a pair of opposed resilient shaft-centering bodies are deployed, each having a handle portion and a pair of tines, the tines forming the partially annular shape and the handle portions passing through opposed apertures in the tube for mounting the shaft-centering bodies therein. Also in FIGS. 12 and 15, the opposed resilient shaft-centering bodies are longitudinally spaced apart.

In the embodiment shown in FIGS. 3-4, the tine portions form a generally annularly shaped structure which defines a slot 56 at a location spaced across from the handle. When a club is dropped against the centering device, it finds the slot as it falls downward, and the centering device picks up the club in the central aperture as it rebounds. Function is believed facilitated where the resilient shaft-centering body has a concave curvature facing upwardly about a centerline extending between the handle and the slot.

While certain preferred embodiments of the invention have been described and disclosed herein, the invention is not to be construed as being so limited, except to the extent that such limitations are found in the claims.

What is claimed is:

1. A golf bag comprising a top face plate, said top face plate defining a plurality of apertures, a bottom face plate defining a plurality of aperatures, a plurality of tubes extending between the face plates, said tubes defining a plurality of passages leading from the apertures in the top face plate, a shaft anti-rotation means positioned in each passage near the bottom face plate, a shaft centering means positioned in each passage near the top face plate, and a cover laterally surrounding the plurality of tubes, wherein the top face plate and the bottom face plate are identical and each defines a plurality of sockets surrounding the plurality of apertures, the sockets of the top face plate facing the sockets of the bottom face plate, and wherein the tubes are fastened to the sockets of the top face plate by the shaft centering means.

2. A golf bag as in claim 1 wherein the tubes are fastened to the sockets of the bottom face plate by the shaft anti-rotation means.

3. A golf bag as in claim 1 wherein each shaft anti-rotation means comprises a single wedge-shaped slide body or a plurality of circumferentially spaced wedge-shaped slide bodies positioned in the passage near the bottom end of the passage, each slide body having a top end, a bottom end, an outer surface positioned closely adjacent to the inside surface of the tube, an inner surface which angled in the range of 1 degree to 45 degrees from a longitudinal axis of the tube and converging in a downward direction toward the longitudinal axis of the tube.

4. A golf bag as in claim 3 wherein each shaft anti-rotation means comprises a plurality of circumferentially spaced wedge-shaped slide bodies.

5. A tube bundle for a golf bag comprising a top face plate, said top face plate defining a plurality of apertures, a bottom face plate, a plurality of tubes extending between the face plates, said tubes defining a plurality of passages leading from the apertures in the top face plate, a shalt anti-rotation means positioned in each passage near the bottom face plate, and a shalt centering means positioned in each passage near the top face plate, wherein each shaft anti-rotation means comprises a plurality of circumferentially spaced wedge-shaped slide bodies positioned in the passage near the bottom end of the passage, each slide body having a top end, a bottom end, an outer surface positioned closely adjacent to the inside surface of the tube, an inner surface which angled in the range of 1degree to 45 degrees from a longitudinal axis of the tube and converging in a downward direction toward the longitudinal axis of the tube, wherein, in at least a portion of the tubes, the bottom ends of the wedge-shaped slide bodies are positioned on a spacer which is positioned on the bottom plate.

6. Apparatus comprising a tube defining a passage, said tube having a top end, a bottom end, and inside surface, and an outside surface, a shaft anti-rotation means positioned in the passage near the bottom end, and a shaft centering means positioned in the passage near the top end, wherein the shaft centering means comprises a pair of opposed resilient shaft-centering bodies, each having a handle portion and a pair of tines, the tines forming a partially annular shape and the handle portions passing through opposed apertures in the tube for mounting the shaft-centering bodies therein, wherein each resilient shaft-centering body of the pair is generally bifurcated fork-shaped, wherein each resilient shaft-centering body is positioned flap-like inside of the tube and has an arcuate surface which assume a generally concentric position around the longitudinal axis of the tube when the shaft-centering body is in a relaxed position.

* * * * *